US006481765B1

(12) United States Patent
Jelavic

(10) Patent No.: US 6,481,765 B1
(45) Date of Patent: Nov. 19, 2002

(54) CODED SECURITY SEAL WITH A PROTECTIVE COVER

(76) Inventor: Ivan Jelavic, Viska 7, 21000 Split (HR)

( * ) Notice: Subject to any disclaimer, the term of this patent is extended or adjusted under 35 U.S.C. 154(b) by 0 days.

(21) Appl. No.: 09/787,149

(22) PCT Filed: Sep. 14, 1998

(86) PCT No.: PCT/HR98/00002

§ 371 (c)(1),
(2), (4) Date: Mar. 13, 2001

(87) PCT Pub. No.: WO00/16296

PCT Pub. Date: Mar. 23, 2000

(51) Int. Cl.[7] ..... B65D 27/30

(52) U.S. Cl. ..... 292/307 R; 292/307 A; 292/320

(58) Field of Search ..... 292/307 R, 307 A, 292/317, 318, 319, 320, 321

(56) References Cited

U.S. PATENT DOCUMENTS 3,591,223 A * 7/1971 Castro Neto ..... 24/16 R
5,114,196 A * 5/1992 Storer ..... 292/307 R
5,118,148 A * 6/1992 De Lima Castro Netto ..... 292/307 R
5,533,767 A 7/1996 Georgopoulos et al.
5,762,386 A 6/1998 Fuehrer
5,782,513 A * 7/1998 Nazzari ..... 292/317
5,788,294 A * 8/1998 Leon et al. ..... 292/307 R
6,128,932 A * 10/2000 Mainetti et al. ..... 292/307 R

FOREIGN PATENT DOCUMENTS

EP 0771922 5/1997

* cited by examiner

*Primary Examiner*—Gary Estremsky
*Assistant Examiner*—Thomas Ho
(74) *Attorney, Agent, or Firm*—Kathleen T. Petrich

(57) ABSTRACT

A security seal with a male part having a security wire extending from it, and a female part that receives the male part. The security wire passes through two grooves on the male part and through a central opening between them. With the security wire so placed, the male part is inserted into the female part where two pairs of resilient spurs on the male part engage knobs in the female part preventing the male part from being removed and a protective cover on the male part receives the female part. The security wire preferably has a metal base with a thin metal thread spirally tightly wound around it that is separable from the metal base when the security wire is violently pulled or bent. The seal is preferably made of a transparent material and preferably has a thread connecting the male and female parts so they stay associated.

20 Claims, 5 Drawing Sheets

D - D

C - C

CODED SECURITY SEAL WITH A PROTECTIVE COVER

BACKGROUND OF THE INVENTION

1. Field of the Invention

The present invention relates, generally, to a security seal or lock, and more particularly to a tamper resistant seal with tamper indicating structure which can be visually inspected to determine whether tampering has occurred.

2. Background Information

Tamper resistant security seals are used to seal many objects such as electric meters, equipment, containers of any kind, as well as wagons, tugs, cisterns, mail bags and trunks. The seal should be very light and inexpensive to manufacture, and provide absolute security and easy handling. It must be impossible to detach the male seal part from the female seal part without visible damage, and the security wire must provide a clear warning that the seal has been twisted or pulled by force. Each seal must be marked with its number and other relevant data. Such a seal should be installed manually without any accompanying tools.

Conventional security seals are one-piece or two-piece devices made of either lead or plastic. A wire is fed through the components to be sealed and the ends of the wire are joined by the device, which is then crimped onto the wire. Unauthorized people can easily misuse such seals by enlarging the opening through which the wire passes, or, for two-piece devices, by disconnecting the body from the casing without damaging it. One wire end is then pulled out allowing easy entry into the protected room or access to the protected equipment. The wire is then pulled through the seal opening again and recrimped into the same condition as it was before the misusage.

U.S. Pat. No. 5,762,386 to Fuechrer discloses a safety seal with a male and female part that interlock. The male part has two longitudinal grooves that are connected by a passage at the bottom of the male part and a top portion with two openings through it, one opening corresponding to each groove. The wire is fed through one opening, along one groove, around the end of the male part, back up the other groove and out the other opening. While the Fuechrer device is more tamper resistant than conventional seals, it still has limitations and shortcomings. The wire makes only one bend around the end of the male part to limit resistance to the wire being pulled out. One embodiment of the device provides additional resistance by providing each channel with contoured sidewalls that cooperatively engage the rope-like outer surface of the wire. That requires the wire to have a contoured outer surface and the channel walls to be made with a mating contour. Another shortcoming occurs at the interface of the top portion of male part with the female part. The top portion only butts against the female part and there is clearance between the two which could allow the inserting of a suitable metal object, such as a knife or needle, for separating the male and female parts.

The present invention provides an the improved security seal which overcomes the limitations and shortcomings of the prior art.

BRIEF SUMMARY OF THE INVENTION

The present invention provides a security seal with the female part, a male part and a security wire. The male part has a protective cover that receives the female part when the seal is installed. This prevents the mechanical separation of the male part from the female part. The male part has two grooves with a central opening between them through which the security wire passes after passing through the components being sealed. When the male part is inserted into the female part, two pairs of spurs on the male part engage knobs of the female part which prevents the male part from being pulled out of the female part. The male part and the female part of the seal are connected by a thread made of the same material to enable easier handling.

The advantages and characteristics of the present invention will become clear to those skilled in the art from the following description, claims and drawings.

DETAILED DESCRIPTION

Figure 3:
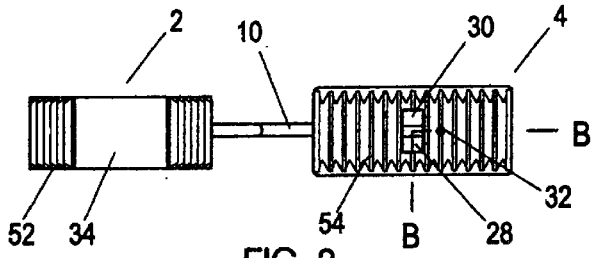
FIG. 3 is an upper side view of the open seal.
Figure 2:
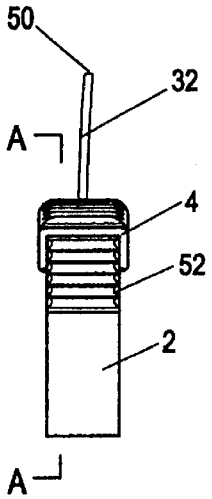
FIG. 2 is a left side view of the open seal.
Figure 1:
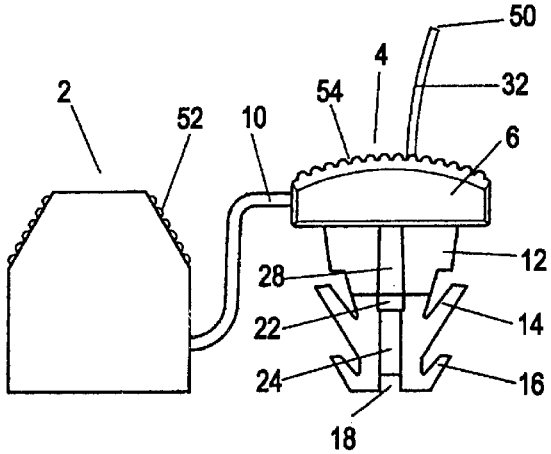
FIG. 1 is a front elevational view of the open seal.
Figure 4:
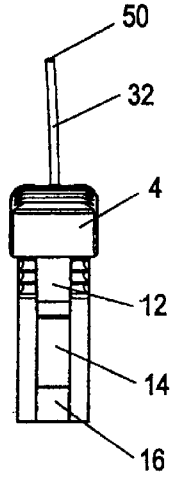
FIG. 4 is a right side view of the open seal.
Figure 5:
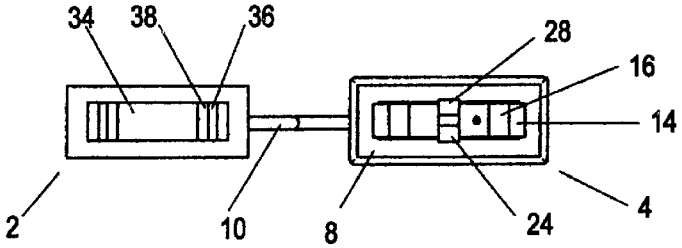
FIG. 5 is a bottom side view of the open seal.

Referring to FIGS. 1–5, an example of the preferred embodiment of the safety seal of the present invention has a flat shape and includes a female part 2 and a male part 4 connected by a thread 10 that keeps them constantly associated. The male part 4 has a protective cover 6, a body 12 extending from the protective cover 6 with an end, and a security wire 32 extending from the protective cover 6 opposite body 12. The security wire 32 has a loose end 50 that is passed through a hole 20 in protective cover 6, around the end of body 12 as will be described below, and out through hole 20 again. Body 12 has two pairs of spurs 14 and 16 which engage knobs 36 and 38 in cavity 34 of female part 2 when body 12 of male part 4 is inserted into cavity 34 of female part 2, after which the male part 4 cannot be pulled out of the female part 2 without visible mechanical damage.

Protective cover 6 has a groove 8 on its brim which receives the top of the female part 2 when the male part 4 is installed into the female part 2. The protective cover 6 fully embraces the top of the female part 2, thereby making it more difficult for a tool to be inserted between the male part 4 and female part 2 to pry them apart.

Body 12 has first and second parallel grooves, one on each side of the body that communicate with hole 20 in protective cover 6. The grooves both have an upper portion 28, 30 and a lower portion 24, 26. There is a passage 18 between the lower portions 24, 26 of the grooves at the bottom of the body 12, and an opening 22 between the grooves near the middle part of the body at the juncture of the upper portions 28, 30 and lower portions 24, 26 of the grooves.

Figure 7:
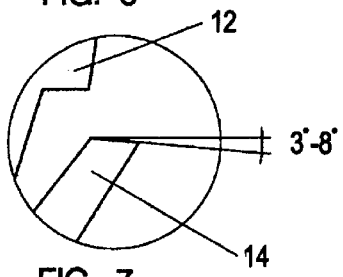
FIG. 7 is a detail view of a portion of FIG. 6 showing the spur top.

Body 12 tapers from the protective cover 6 towards the bottom of the body 12. Body 12 has two symmetrical pairs of resilient spurs 14, 16. One pair of spurs 14 near the middle of the body are longer, and the other pair of spurs 16 near the bottom are shorter. As shown in FIG. 7, the top ends of the spurs 14, 16 are beveled downward, preferably 3–8 degrees, which guarantees a firm connection on the knobs 36, 38 in the female part 2.

Figure 6:
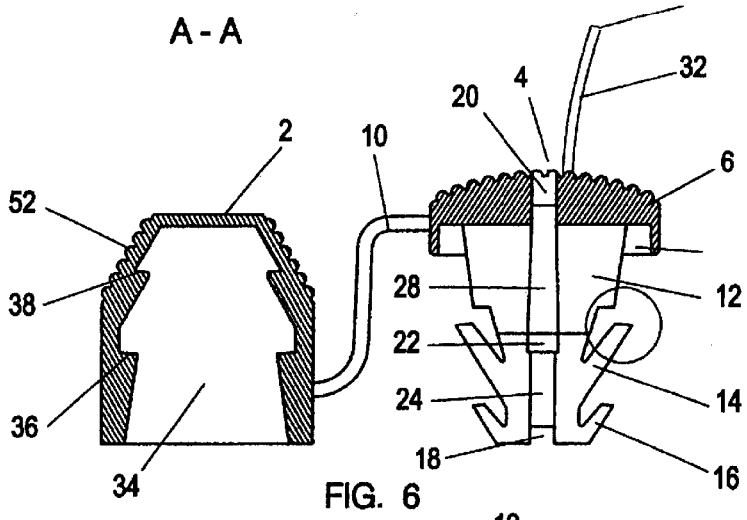
FIG. 6 is a cross sectional view taken along the line A—A of FIG. 2.

Referring to FIG. 6, the female part 2 has a cavity 34 with opposed sidewalls having knobs 36 and 38 with which the pairs of the spurs 14 and 16 respectively engage when the male part 4 is inserted into the cavity 34 of the female part 2. Cavity 34 is slightly tapered inward at its front to facilitate insertion of male part 4.

Figure 8:
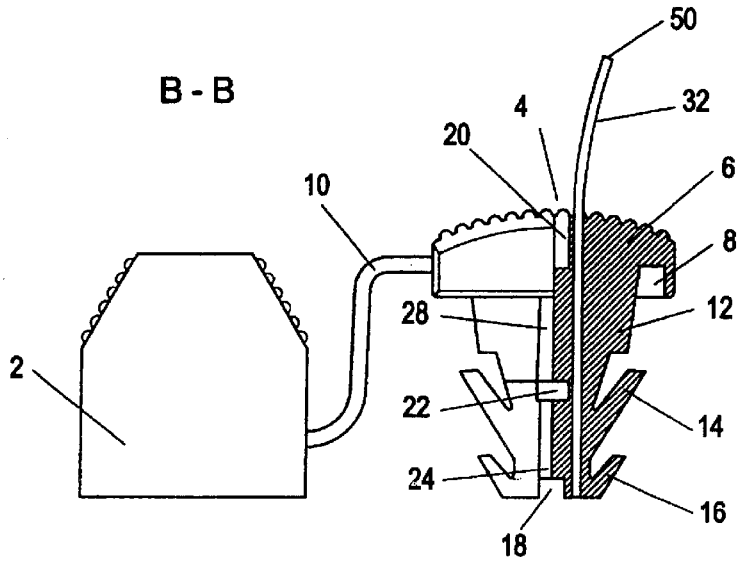
FIG. 8 is the view of FIG. 1 with a partial sectional view taken along the line B—B of FIG. 3.

Referring to FIG. 8, the security wire 32, is embedded into the male part 4 and it preferably extends through the entire length of body 12. The free end 50 of security wire 32 can be of any length suitable to engage the objects to be sealed.

Figure 9:
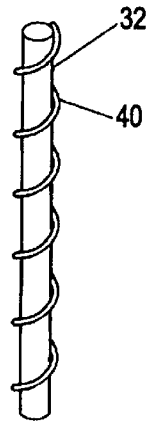
FIG. 9 is a perspective view of a portion of the security wire.
Figure 12:
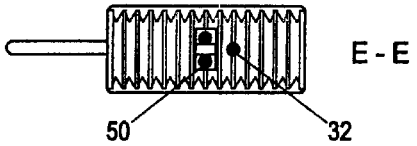
FIG. 12 is a top view of the assembled seal with the security wire shown in cross-section along the line E—E of FIG. 10.
Figure 11:
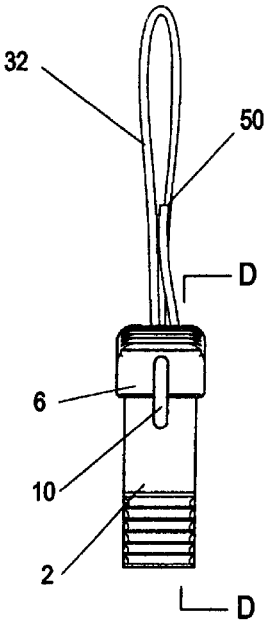
FIG. 11 is a left side view of the assembled seal.

Referring to FIG. 9, the security wire 32 has a metal base around which a thin metal thread 40 is spirally tightly wound. The security wire made in such a way provides enough friction to guarantee that the security wire cannot be pulled out after installing the male part into the female part. Each violent pulling or bending of the security wire 32 causes the separation of the thin thread 40 from the metal base, visually indicating that there has been an unauthorized attempt to pull out the security wire from the body of the seal.

Referring to FIGS. 10–17, the free end 50 of security wire 32 is pulled through an object to be sealed 42, 44, then pulled through the male part 4.

Figure 15:
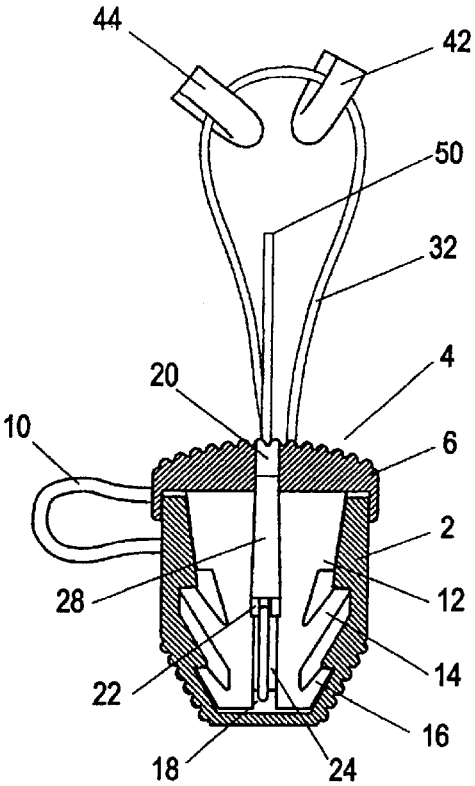
FIG. 15 is a cross-sectional view taken along the line D—D of FIG. 11.
Figure 16:
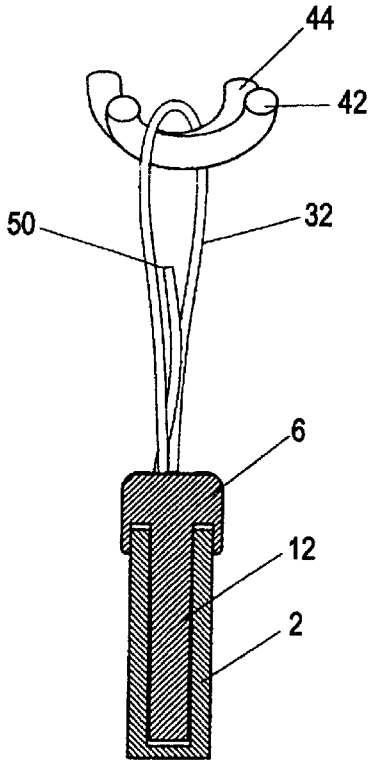
FIG. 16 is a cross-sectional view taken along the line C—C of FIG. 10.

One of the ways in which the security wire 32 can be installed into the male part 4 is shown in FIG. 15. After engaging the objects to be sealed 42 and 44, the loose end of the security wire 50 is then pulled through opening 20 into upper portion 30 of the first groove, then through the opening 22 to the second groove and downward into the lower portion 24. It is then passed through the passage 18 into the lower portion 26 of the first groove then upward again into upper portion 30 and finally comes out through the opening 20.

The security wire may also be pulled through in such a way that after it has passed through the opening 20 it runs along the upper portion 28 and lower portion 24 of the first groove, passes through the passage 18, then runs upward along the lower portion 24 of the second groove to the opening 22 through which the wire is pulled to the upper portion 28 of the first groove and again through the opening 20 out of the male part 4.

After the security wire 32 has been pulled through the male part 4, the male part 4 is inserted into the female part 2. As body 12 is received in cavity 34, the longer spurs 14 slide along the longer slope of the female part while the shorter spurs 16 pass through freely. Because of their elasticity, the longer spurs bend slightly towards the center. As the longer spurs 14 approach the end of the slope or knobs 36, the shorter spurs 16 simultaneously touch the slope near the knobs 38 and bend slightly. The groove 8 in protective cover 6 also receives the top of female part 2. By further pushing of the male part 4 into the female part 2, both pairs of spurs are pushed simultaneously into the foreseen enlargements and promptly spread apart, the ends of the spurs 14, 16 abutting the knobs 36, 38 respectively. Then a click-sound can be heard indicating that the male part has reached the bottom of the female part, and removing body 12 with spurs 14 and 16 from female part 2 without visible damage is impossible. A short play that can be felt when pulling the protection cover after that shows that the seal has been correctly installed.

The outer shorter side of the female part 2 has ridges 52, and the upper outside of the protective cover 6 has ridges 54. These ridges improve a person's grip on the parts to enable secure and easy inserting of the male part into the female part of the seal without the aid of tools.

Figure 10:
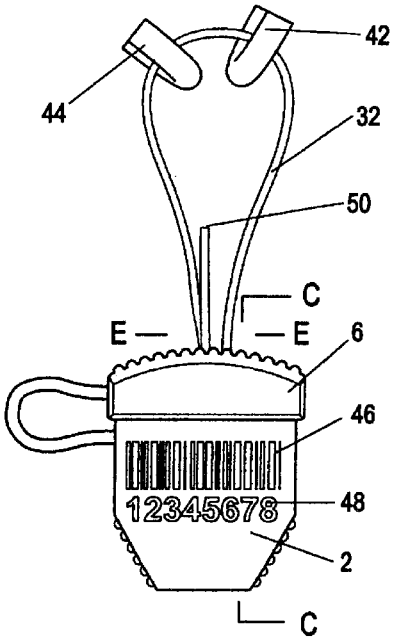
FIG. 10 is a front elevational view of the assembled seal.
Figure 13:
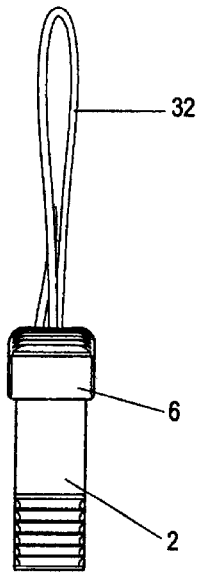
FIG. 13 is a right side view of the assembled seal.
Figure 14:
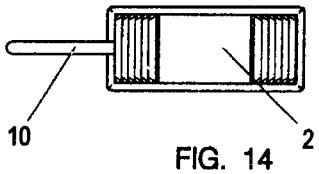
FIG. 14 is a bottom view of the assembled seal.
Figure 17:
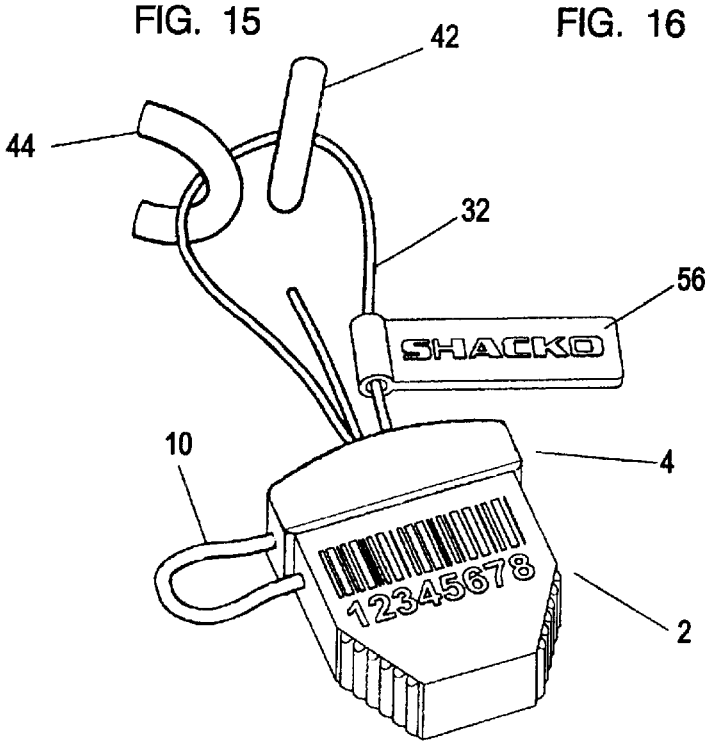
FIG. 17 is a perspective view of the assembled seal with code and alphanumerical signs and flag.

The closed seal installed on objects to be sealed 42 and 44 appears as illustrated in FIGS. 10–17. In this condition the seal provides secure protection, and each violent attempt to open it leaves visible mechanical traces. FIGS. 10 and 17 show the installed seal with a code 46 and alphanumerical symbols 48 on the broader side of the female part 2. Other relevant data can be written on the other side too. A flag 56 attached to the security wire 32 may contain a mark of the seal user.

Figure 18:
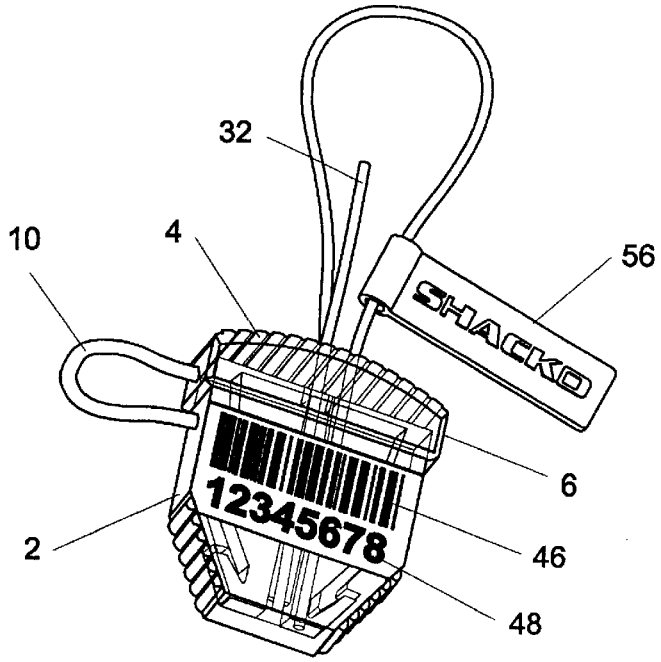
FIG. 18 is a perspective view of the assembled transparent seal from its front.
Figure 19:
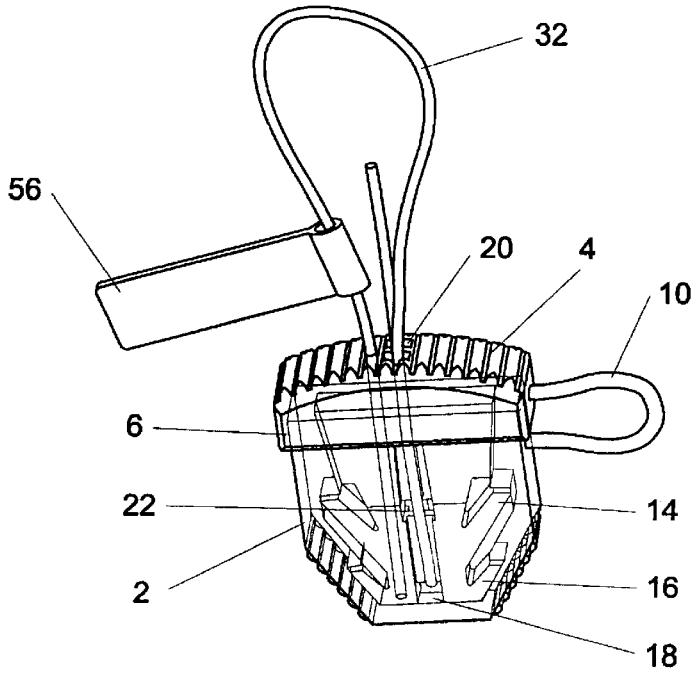
FIG. 19 is a perspective view of the assembled transparent seal from its back.

Referring to FIGS. 18 and 19, the male and female parts of the seal may be made of a transparent material, which enables any kind of violent opening or sloppy assembling to be noticed easily.

The descriptions above and the accompanying drawings should be interpreted in the illustrative and not the limited sense. While the invention has been disclosed in connection with the preferred embodiment or embodiments thereof, it should be understood that there may be other embodiments which fall within the scope of the invention as defined by the following claims.

What is claimed is:

1. A security seal comprising:

a female part having an internal cavity;

a male part adapted to be received in the internal cavity, the male part including a protective cover and a body portion extending therefrom having a middle and an end, the protective cover having a central hole and a brim with a groove that receives the female part in an assembled condition of the seal, the body portion having opposite sides and first and second parallel grooves that communicate with the hole in the protective cover, one groove being on each opposite side, each groove having an upper portion and a lower portion, the grooves having a passage between their lower portions at the end of the body and an opening between the grooves where the upper and lower portions meet near the middle of the body; and a security wire secured to the male part, the security wire having a free end extending from the protective cover which is received by the hole in the protective cover, passes along the grooves and through the passage and opening between the grooves and exits the hole when the seal is in an assembled condition.

2. The security seal of claim 1, wherein the free end of the security wire passes along the upper portion of the first groove, through the opening between the grooves, along the lower portion of the second groove, through the passage at the end of the body, then back along the lower portion and upper portion of the first groove.

3. The security seal of claim 1, wherein the free end of the security wire passes along the upper and lower portions of the first groove, through the passage at the end of the body, then back along the lower portion of the second groove, through the opening between the grooves, then along the upper portion of the first groove.

4. The security seal of claim 1, wherein the body has first and second symmetrical pairs of resilient spurs, the first pair being near the middle of the body and the second pair being near the end, the first pair being longer than the second pair, and wherein the cavity has opposed sidewalls with two pairs of knobs with which the pairs of spurs respectively engage when the seal is in an assembled condition, the spurs having ends which abut the knobs so that the male part cannot be removed from the female part without visible damage.

5. The security seal of claim 4, wherein the ends of the spurs have tops beveled downward.

6. The security seal of claim 5, wherein the tops of the spurs are beveled downward 3–8 degrees.

7. The security seal of claim 4, wherein the internal cavity tapers inward.

8. The security seal of claim 1, were in the security wire is embedded in the male part.

9. The security seal of claim 8, wherein the security wire extends the full-length of the male part.

10. The security seal of claim 1, wherein the security wire has a metal base with a thin metal thread spirally tightly wound around it, the thin metal thread being separably from the metal base when the security wire is violently pulled or bent.

11. The security seal of claim 1, wherein the protective cover has an outer portion with ridges and the female part has an outer portion with ridges, the ridges improving a person's grip on the parts to enable secure and easy inserting of the male part into the female part of the seal without the aid of tools.

12. The security seal of claim 1, wherein the female part has an external face on which code, alphanumeric symbols or other indicia are placed.

13. The security seal of claim 1, wherein a flag is attached to the security wire, the flag being constructed to allow indicia to be applied.

14. The safety seal of claim 1, wherein the male and female parts are made of transparent material which makes any violent attempt to open the seal or any incorrect assembly easily visible.

15. The safety seal of claim 1, wherein the male part and the female part are joined by a thread to keep them associated.

16. The safety seal of claim 15, wherein the thread is made of the same material that as the male and female parts.

17. A security seal comprising:

a female part having an internal cavity with opposed sidewalls with two pairs of knobs;

a male part adapted to be received in the internal cavity, the male part including a protective cover and a body portion extending therefrom having a middle and an end, the protective cover having a central hole and a brim with groove that receives the female part in an assembled condition of the seal, the body portion having opposite sides and first and second parallel grooves that communicate with the hole in the protective cover, one groove being on each opposite side, each groove having an upper portion and a lower portion, the grooves having a passage between their lower portions at the end of the body and an opening between the grooves where the upper and lower portions meet near the middle of the body, the body having first and second symmetrical pairs of resilient spurs, the first pair being near the middle of the body and the second pair being near the end, the first pair being longer than the second pair, the pairs of spurs engaging the knobs when the seal is in an assembled condition, the spurs having ends which abut the knobs so that the male part cannot be removed from the female part without visible damage; and a security wire secured to the male part, the security wire having a free end extending from the protective cover which is received by the hole in the protective cover, passes along the grooves and through the passage and opening between the grooves and exits the hole when the seal is in an assembled condition.

18. A security seal comprising:

a female part having an internal cavity;

a male part adapted to be received in the internal cavity, the male part including a protective cover and a body portion extending therefrom having middle and an end, the protective cover having a central hole and a brim with a groove that receives the female part in an assembled condition of the seal, the body portion having opposite sides and first and second parallel grooves that communicate with the hole in the protective cover, one groove being on each opposite side, each groove having an upper portion and a lower portion, the grooves having a passage between their lower portions at the end of the body and an opening between the grooves where the upper and lower portions meet near the middle of the body; and a security wire secured to the male part, the security wire having a free end extending from the protective cover which is received by the hole in the protective cover, passes along the grooves and through the passage and opening between the grooves and exits the hole when the seal is in an assembled condition, the security wire having a metal base with a thin metal thread spirally tightly wound around it, the thin metal thread being separable from the metal base when the security wire is violently pulled or bent.

19. A security seal comprising:

a female part having an internal cavity:

a male part adapted to be received in the internal cavity, the male part including a protective cover and a body portion extending therefrom having a middle and an end, the protective cover having a central hole, the body portion having opposite sides and first and second parallel grooves that communicate with the hole in the protective cover, one groove being on each opposite side, each groove having an upper portion and a lower portion, the grooves having a passage between their lower portions at the end of the body and an opening between the grooves where the upper and lower portions meet near the middle of the body; and a security wire secured to the male part, the security wire having a free end extending from the protective cover which is received by the hole in the protective cover, passes along the grooves and through the passage and opening between the grooves and exits the hole when the seal is in an assembled condition.

20. A security seat comprising:

a female part having an internal cavity;

a male part adapted to be received in the internal cavity, the male part including a protective cover and a body portion extending therefrom having a middle and an end, the protective cover having a central hole, the body portion having opposite sides and first and second parallel grooves that communicate with the hole in the protective cover, one groove being on each opposite side, each groove having an upper portion and a lower portion, the grooves having a passage between their lower portions at the end of the body and an opening between the grooves where the upper and lower portions meet near the middle of the body; and a security wire secured to the male part, the security wire having a free end extending from the protective cover.

* * * * *

UNITED STATES PATENT AND TRADEMARK OFFICE

CERTIFICATE OF CORRECTION

PATENT NO. : 6,481,765 B1
DATED : November 19, 2002
INVENTOR(S) : Ivan Jelavic

It is certified that error appears in the above-identified patent and that said Letters Patent is hereby corrected as shown below:

Column 5,
Line 3, substitute “separably” with -- separable --;

Column 6,
Line 1, substitute “seat” with -- seal --.

Signed and Sealed this

Twenty-second Day of June, 2004

JON W. DUDAS
*Acting Director of the United States Patent and Trademark Office*